US007066237B2

(12) United States Patent
Miyazaki et al.

(10) Patent No.: US 7,066,237 B2
(45) Date of Patent: Jun. 27, 2006

(54) METHOD OF MANUFACTURING AUSTENITIC STAINLESS STEEL SHEET CAST PIECE

(75) Inventors: Masafumi Miyazaki, Futtsu (JP); Shuichi Inoue, Hikari (JP); Toshikazu Nishimura, Hikari (JP); Hiroshige Inoue, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/509,404

(22) PCT Filed: Mar. 27, 2003

(86) PCT No.: PCT/JP03/03891

§ 371 (c)(1),
(2), (4) Date: Sep. 24, 2004

(87) PCT Pub. No.: WO03/080273

PCT Pub. Date: Oct. 2, 2003

(65) Prior Publication Data

US 2005/0217822 A1 Oct. 6, 2005

(30) Foreign Application Priority Data

Mar. 27, 2002 (JP) ..... 2002-087702

(51) Int. Cl.
*B22D 11/06* (2006.01)

(52) U.S. Cl. ..... 164/480; 164/428

(58) Field of Classification Search ..... 164/479–482, 164/428–433
See application file for complete search history.

(56) References Cited

FOREIGN PATENT DOCUMENTS

| | | | |
|---|---|---|---|
| JP | 2-63650 | * | 3/1990 |
| JP | 3-254336 | * | 11/1991 |
| JP | 5-23861 | | 2/1993 |
| JP | 5-293601 | | 11/1993 |
| JP | 7-268556 | | 10/1995 |
| JP | 8-215797 | * | 8/1996 |
| JP | 2851252 | | 10/1996 |
| JP | 2851252 | * | 11/1998 |
| JP | 2000-219919 | | 8/2000 |

* cited by examiner

*Primary Examiner*—Kuang Y. Lin
(74) *Attorney, Agent, or Firm*—Baker Botts LLP

(57) ABSTRACT

Methods for casting an austenitic stainless steel thin strip casting through a continuous caster, e.g., a twin-drum type caster, in which the mold walls move synchronous with the casting to obtain a casting, wherein defects, e.g., salt-and-pepper unevenly glossy defects, on a steel sheet formed after cold rolling or cold forming are prevented. In particular, casting an austenitic stainless steel thin strip casting by regulating a pressing force P of mold wall faces against the casting in the range from more than 1.0 to less than 2.5 t/m, and preferably from more than 1.1 to not more than 1.6 t/m. The continuous caster used may be a twin-drum type continuous caster, with a drum radius R(m) and a pressing force P(t/m) of mold wall faces satisfying the relation $0.5 \leqq (\sqrt{R}) \times P \leqq 2.0$, and preferably $0.8 \leqq (\sqrt{R}) \times P \leqq 1.2$.

11 Claims, 4 Drawing Sheets

METHOD OF MANUFACTURING AUSTENITIC STAINLESS STEEL SHEET CAST PIECE

CROSS-REFERENCE TO RELATED APPLICATION(S)

This application is a national stage application of PCT Application No. PCT/JP03/03891, which was filed on Mar. 27, 2003 and published on Oct. 2, 2003 as International Publication No. WO 03/080273 (the "International Application"). This application claims priority from the International Application pursuant to 35 U.S.C. § 365. The present application also claims priority under 35 U.S.C. § 119 from Japanese Patent Application No. 2001-335895, filed on Mar. 27, 2003, the entire disclosure of which is incorporated herein by reference.

FIELD OF THE INVENTION

The present invention relates to methods for casting an austenitic stainless steel thin strip casting through a continuous caster. In particular, casting an austenitic stainless steel thin strip casting through a continuous caster, e.g., a twin-drum type caster, in which the mold walls move synchronous with the casting to obtain a casting, wherein defects on a steel sheet formed after cold rolling or cold forming are prevented.

BACKGROUND

Synchronous continuous casting processes are processes that do not have a relative speed difference between a casting and the inner walls of a mold. For example, such as a twin-drum process (a twin-roll process), a twin-belt process, a single-roll process and the like. A twin-drum type synchronous continuous casting process is a continuous casting process that consists of the steps of: (i) pouring molten steel into a continuous casting mold composed of a pair of cooling drums, which may have identical diameters or different diameters and may be disposed in parallel or with an inclination relative to each other, and side weirs for sealing both end faces of the cooling drums; (ii) forming a solidified shell on the circumference of each of the cooling drums; and (iii) uniting the solidified shells near a position where the rotating cooling drums come closest to each other (the so-called "kissing point) to form a united thin strip casting.

It is known that surface defects (e.g., unevenly glossy defects on the surface of a cold-rolled product and rough surface defects on the surface of a formed product) are sometimes generated along the rolling direction of a product. For example, surface defects may be formed when the product is produced by cold rolling, with hot rolling not applied beforehand, and thin strip casting through a twin-drum type continuous casting process or the like, when cold forming (e.g., draw forming or stretch forming) is applied thereto. These surface defects are generated in a different manner from the "orange peel phenomenon," which depends on the diameter of the crystal grains of a cold-rolled product, individually or compositely. In particular, the defects may be in the forms of: (1) small undulated surface defects not more than several millimeters in length and not more than 0.5 mm in width on average; and (2) large stream patterned surface defects not more than several hundred millimeters in length and not more than 3 mm in width on average. For example, these surface defects may be observed when a BA product (a product produced through bright annealing) is subjected to stretch forming and may deteriorate the appearance of the formed product.

The small undulated surface defects, of not more than several millimeters in length and not more than 0.5 mm in width, may be generated in steel where δ-ferrite remains in an austenite phase. These surface defects may be caused by the uneven structures formed on the surfaces of a casting as a result of the variation of the residual amount of δ-ferrite due to the heat history of the casting. Thus, the positions where the surface defects are generated on the top and bottom surfaces of a steel sheet are not identical with each other. Japanese Patent Publication No. H5-23861, the entire disclosure of which is incorporated herein by reference, discloses a method of preventing surface defects on a steel sheet product by adjusting the interval of dimples on the surfaces of the cooling drums. Additionally, Japanese Patent Publication No. H5-293601, the entire disclosure of which is incorporated herein by reference, discloses a method of eliminating δ-ferrite on the surface layers of a casting by delaying the cooling of the casting after it comes out of a high temperature mold. Further, Japanese Patent Publication No. 2000-219919 the entire disclosure of which is incorporated herein by reference, discloses a method comprising the steps of: (i) casting a thin strip casting; (ii) imposing a strain to the vicinity of the surfaces of the casting through shot blasting; and (iii) annealing. Thus, recrystallization of the strained surface during annealing creates uniformly sized crystal grains and therefore removes the surface gloss.

The large stream patterned surface defects, not more than several hundred millimeters in length and not more than 3 mm in width, are caused by the local variation of deformation resistance due to uneven distribution of Ni segregation (e.g., normal segregation and inverse segregation) remaining at the finally solidified portion of a casting, e.g., at a portion in the middle of the thickness of a steel sheet product. These surface defects are generated at identical positions on both the top and bottom surfaces of a steel sheet. Japanese Patent Publication No. H7-268556, the entire disclosure of which is incorporated herein by reference, discloses that Ni segregation is mitigated by performing casting while the degree of superheat ΔT of molten steel is controlled to not higher than 50° C. during continuous casting and thus minimizing the flow of the molten steel at the finally solidified portion.

Japanese Patent No. 2851252, the entire disclosure of which is incorporated herein by reference, discloses that Ni segregation is caused by semisolidified molten steel, which is in a state close to final solidification and has a solid phase ratio of less than about 1.0, is moved in the direction of the sheet width or in the direction of casting by a driving force. This driving force is created by the pressing force P of a mold, imposed when a casting is formed by sticking the solidified shells together on the mold wall faces. Consequently, Ni segregation may be mitigated and therefore reduce surface defects by defining the pressing force P as a function of a degree of superheat ΔT of molten steel and controlling the pressing force P to roughly not more than 5 t/m, and more particularly to controlling the pressing force P to about 2.5 t/m.

By the various corrective measures described above, the surface defects generated when a product produced by cold-rolling a thin strip casting is subjected to cold forming have been significantly improved. However, it has been found that previously unknown minute surface defects may be generated. These new surface defects are sometimes recognized as unevenly glossy defects at the stage of a cold-rolled steel sheet in the same way as before, but are far finer and smaller than the previously known defects. Further, when these new defects are very small they are not recognized as unevenly glossy defects at the stage of a cold-rolled steel sheet or after usual cold forming but are found as minute rough surface defects after excessive cold forming is applied, e.g., deep drawing or stretch forming, which may cause problems in some applications. Therefore, these defects must be eliminated in cold-rolled steel sheet applications, e.g., where buffing after forming is omitted.

As described above, the conventional large stream patterned surface defects are generated at identical positions on both the top and bottom surfaces of a steel sheet. The protrusions and depressions thereof are distributed in the form of streaks or lines with a height difference between a protrusion and a depression of about 1 to 3 μm. A Ni segregation portion is located where the conventional large stream patterned surface defect is generated, with normal segregation and inverse segregation existing in the form of bands in the middle of the sheet thickness. In contrast, although the newly found surface defects are generated at identical positions on both the top and bottom surfaces of a steel sheet the protrusions and depressions are distributed sporadically and in a zigzag pattern in the form of spots, with a length of several tens of millimeters and a height difference between protrusions and depressions of from about 0.1 μm to about 1 μm. Thus, these newly found surface defects have been named "salt-and-pepper unevenly glossy defects" at the stage of a cold-rolled steel sheet. At a portion where a salt-and-pepper unevenly glossy defect is generated in the middle of the sheet thickness, an Ni inverse segregation portion exists and normal segregation does not exist in the adjacent vicinity. In this respect, a salt-and-pepper unevenly glossy defect is differentiated from a conventional rough surface defect where both normal segregation and inverse segregation coexist.

SUMMARY OF THE INVENTION

The present invention relates to methods for casting an austenitic stainless steel thin strip casting through a continuous caster. In particular, casting an austenitic stainless steel thin strip casting through a continuous caster, e.g., a twin-drum type caster, in which the mold walls move synchronous with the casting to obtain a casting, wherein defects, e.g., salt-and-pepper unevenly glossy defects, on a steel sheet formed after cold rolling or cold forming are prevented.

According to one embodiment of the present invention, a method for producing an austenitic stainless steel thin strip casting through a continuous caster, wherein mold walls move synchronously with the casting, includes applying a pressing force P of at least one mold wall face against a casting is more than about 1.0 and less than about 2.5 t/m. In a further embodiment, the pressing force P of the at least one mold wall face against the casting is more than about 1.1 and less than about 1.6 t/m.

According to another embodiment of the present invention, a method for producing an austenitic stainless steel thin strip casting through a continuous caster, wherein the mold walls move synchronously with the casting, the continuous caster is a twin-drum type continuous caster, and the drum radius R(m) and the pressing force P(t/m) of at least one mold wall face satisfies the relation $0.5 \leqq (\sqrt{R}) \times P \leqq 2.0$. According to a further embodiment of the present invention, the drum radius R(m) and the pressing force P(t/m) of at least one mold wall face satisfies the relation $0.8 \leqq (\sqrt{R}) \times P \leqq 1.2$.

According to another embodiment of the present invention, the height of a molten steel pool formed between at least two mold walls is more than about 200 mm and less than about 450 mm.

According to another embodiment of the present invention, a solidification time, defined by a span of time between a time when at least one moving mold wall contacts molten steel to a time when at least two solidified shells unite, is more than about 0.4 second and less than about 1.0 second.

According to another embodiment of the present invention, in-line rolling is applied during the process from molding to coiling.

According to another embodiment of the present invention, a degree of Ni inverse segregation, defined by the ratio of an amount of Ni at Ni inverse segregation portions to an average amount of Ni in an entire steel is in the range from about 0.90 to about 0.97.

BRIEF DESCRIPTION OF THE DRAWINGS

FIG. 5(*b*) is a perspective sectional view showing the formation of salt-and-pepper unevenly glossy defects on a steel sheet after cold-forming.

DETAILED DESCRIPTION

The mechanism of generating the conventional large stream patterned rough surface defects, not more than several hundred millimeters in length and not more than 3 mm in width, as discussed above, may be caused by Ni segregation due to the movement of semisolidified molten steel, i.e., steel in a state close to solidification with a solid phase ratio of approximately less than 1.0, in the direction of the sheet width or in the direction of casting, which results from a driving force and causes rough surface defects, e.g., unevenly glossy defects. This mechanism can be estimated since Ni normal segregation and Ni inverse segregation coexist adjacently and there is a mass balance of both.

Figure 5A:
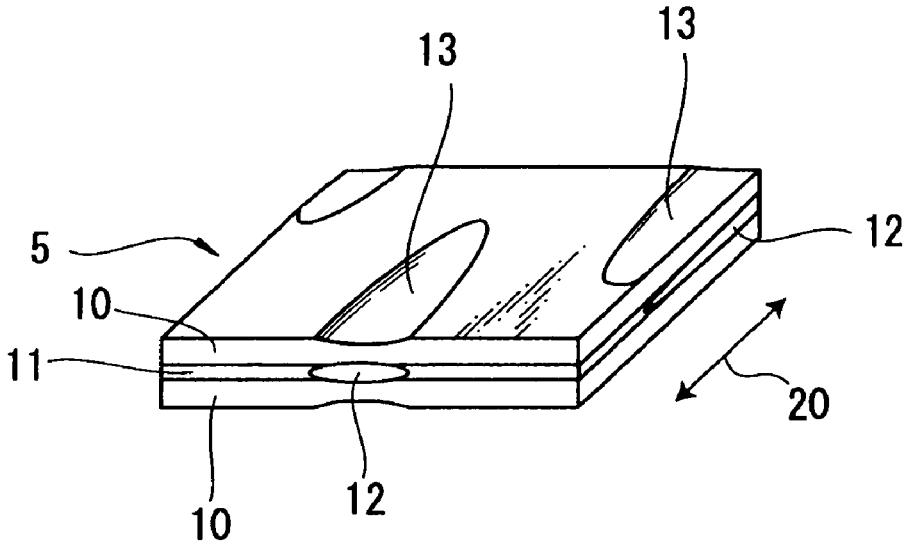
FIG. 5(*a*) is a perspective sectional view showing the formation of salt-and-pepper unevenly glossy defects on a steel sheet after cold rolling and annealing.
Figure 5B:
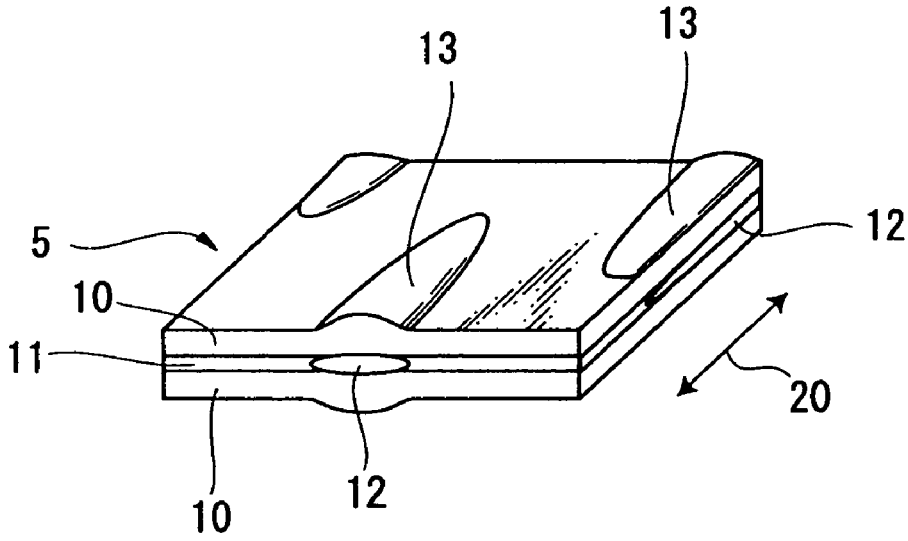

On the other hand, in the case of salt-and-pepper unevenly glossy defects that are the subject of the present invention, as shown in FIG. 5, the size of each of the defects are on the order of about several tens of millimeters in length in the casting direction 20 and several millimeters in width. These defects are generated separately from each other and distributed sporadically, randomly and zigzagged in an area of about several hundreds of millimeters in the casting direction and several tens of millimeters in the width direction at each portion of a casting 5. The unevenly glossy defects 13 are generated at identical portions on both the top and bottom surfaces of a casting and a Ni inverse segregation portion 12 exists at the portion where an unevenly glossy defect is generated in a crystal portion 11 that is located at the middle portion of the sheet thickness. The degree of Ni inverse segregation (the ratio of the amount of Ni at Ni inverse segregation portions to the average amount of Ni in the steel) is roughly not more than about 0.9. When annealing is applied after cold rolling, as shown FIG. 5(*a*), a phenomenon is observed wherein the sheet thickness at a portion where an unevenly glossy defect 13 is generated is thinner by about 0.1 μm as compared to the adjacent portions. This is because the amount of work-induced martensite, formed by cold rolling at an Ni inverse segregation portion 12, is larger than at the adjacent portions, and thus volume shrinkage increases at a Ni inverse segregation portion 12 after annealing generating a depression. When cold forming, such as stretch forming or draw forming, is applied on top of that, as shown in FIG. 5(*b*), a phenomenon is observed wherein the sheet thickness at a portion where an unevenly glossy defect 13 is generated is thicker by about 1 μm as compared to the adjacent portions. This is because plastic deformation is uneven during forming due to the unevenness of the martensite amount as stated above. As a result, a salt-and-pepper unevenly glossy defect is generated at a portion corresponding to a Ni inverse segregation portion on the surface of a steel sheet after forming.

Since uneven plastic deformation during forming functions rather strongly, as compared to volume shrinkage after annealing in the aforementioned mechanism, the height difference between a protrusion and a depression will be larger for uneven plastic deformation. Therefore, depending on the degree of Ni inverse segregation, there may be a situation where Ni inverse segregation becomes significant after cold forming. For example, rough surface defects may appear after cold forming even though such defects are not present in a steel sheet after cold rolling and annealing. In such a situation conventional large stream patterned surface defects, not more than several hundred millimeters in length and not more than 3 mm in width, may be a problem.

Ni segregation (normal segregation and inverse segregation) that causes surface defects may be improved by evaluating the amount of Ni, for example, roughly in a region of 25 μm in the thickness direction and 500 μm in the width direction at a segregation portion in the case of conventional large stream patterned surface defects, for example, as disclosed in Japanese patent No. 2851252, the entire disclosure of which is incorporated herein by reference. However, since salt-and-pepper unevenly glossy defects appear very minutely and sporadically, it may be difficult to evaluate segregation by this method since it may be necessary to evaluate Ni amount in detail over a wider range. In particular, it may be necessary to evaluate Ni segregation in a range of about several millimeters in the width direction in the case of salt-and-pepper unevenly glossy defects.

On the basis of the aforementioned nature of salt-and-pepper unevenly glossy defects, the mechanism of generating a Ni inverse segregation portion at the middle portion of the sheet thickness can be estimated as follows. When molten steel begins to solidify by contacting with mold walls immediately under a meniscus, as molten steel components including Ni in a liquid phase do not yet begin to concentrate, the concentration of each component in an initial solidification structure is basically in the state of inverse segregation, depending on the distribution coefficient of each component. The initial solidification structure is cooled directly by the mold walls, thus the speed of solidification is high and therefore a structure composed of chilled crystals is formed. When solidification proceeds, the components on the liquid phase side of the interface between the solid phase and the liquid phase concentrate, whereas the concentration of the components on the solid phase side are equal to the initial concentrations of the components in molten steel.

In addition, during solidification the structure transforms from chilled crystals to columnar crystals. It is known that such chilled crystals of Ni inverse segregation generated immediately under a meniscus, as described above, tend to separate from solidified shells and turn to free chilled crystals, based on a function of compositional supercooling at the interface between a solid phase and a liquid phase. The free chilled crystals are suspended in a supercooling zone, or massy zone, on the liquid phase side of the interface between a solid phase and a liquid phase, and move together with solidified shells formed along the mold walls, and reach a kissing point where both the left and right solidified shells contact with each other and are united. An equiaxed crystal region (i.e., a solid and liquid coexisting region) is formed with chilled crystals acting as nuclei right above the kissing point.

When a material balance is reached between the upper part and the lower part of a kissing point, free chilled crystals of Ni inverse segregation that have reached the middle portion of a sheet thickness right above a kissing point are fed, together with equiaxed crystals, to the middle portion of the sheet thickness while accompanying solidified shells and, as a result, inverse segregation regions are formed at the middle portion of the sheet thickness uniformly in the directions of the width and length.

On the other hand, when a material balance is disturbed between the upper part and the lower part of a kissing point and equiaxed crystal regions, wherein a solid phase and a liquid phase coexist, are not fed to the middle portion of a sheet thickness, substances containing chilled crystals of Ni inverse segregation accumulate right above the kissing point. When such accumulated substances are trapped in solidified shells irregular Ni inverse segregation regions may be formed at the portion where the accumulated substances are trapped in the middle portion of a sheet thickness and the trapped portions may be differentiated from the other portions. Since the substances trapped in the solidified shells occurs randomly in the directions of the width and length of a casting, the Ni segregation portions at the middle portion of a sheet thickness may cause salt-and-pepper unevenly glossy defects.

According to the present invention the material balance between the upper part and the lower part of a kissing point may depend on the pressing force of the mold wall faces at the kissing point and, in the region of the pressing force substances containing chilled crystals of Ni inverse segregation tend to accumulate right above the kissing point. Therefore, by using the appropriate pressing force the accumulation of the substances containing chilled crystals of Ni inverse segregation may be reduced or eliminated. As a result, Ni inverse segregation portions that exist in the salt-and-pepper state at the middle portion of a sheet thickness are removed and the generation of salt-and-pepper unevenly glossy defects is eliminated.

Salt-and-pepper unevenly glossy defects may appear with a mold wall face pressing force P of 2.5 t/m. Thus, according to one embodiment of the present invention, generation of salt-and-pepper unevenly glossy defects may be reduced by controlling a pressing force P to less than about 2.5 t/m. According to another embodiment of the present invention, generation of salt-and-pepper unevenly glossy defects may be reduced by controlling a pressing force P to less than about 1.6 t/m. As used herein, the pressing force P(t/m) is a value obtained by dividing a whole pressing force (t) of a mold wall face by the mold width (m), and thus is defined as the pressing force per unit mold width. For example, a mold width equals a drum width in the case of a twin-drum type continuous caster.

However, when the pressing force is excessively small, center pores appear at the middle portion of the sheet thickness of a casting. In particular, center pores may appear when a pressing force P of 1.0 t/m is used. Thus, according to one embodiment of the present invention center pores may be reduced or eliminated by using a pressing force P of more than about 1.0 t/m. According to another embodiment of the present invention, center pores may be further reduced or eliminated by using a pressing force P of more than about 1.1 t/m. In yet another embodiment of the present invention, center pores may be further reduced or eliminated by using a pressing force P of more than about 1.2 t/m.

In the case where a continuous caster is a twin-drum type continuous caster, a preferable result can be obtained by specifying a pressing force P of mold wall faces in accordance with a drum radius R. In particular, a good result may be obtained according to the present invention by regulating a drum radius R(m) and a pressing force P(t/m) of the mold wall faces in terms of the range of the value $(\sqrt{R})\times P$.

As discussed above, when the pressing force is too large, Ni inverse segregation appears at the middle portion of a sheet thickness. As a drum radius increases, the region of molten pool adjacent to a kissing point deepens with the upper part thereof narrowing and equiaxed crystals tend to accumulate with chilled crystals of Ni inverse segregation acting as nuclei. Therefore, as the drum radius increases the upper limit in the appropriate range of a pressing force beyond which salt-and-pepper unevenly glossy defects appear shifts toward a lower value. In contrast, as the drum radius decreases, the region of molten pool adjacent to a kissing point becomes shallower with the upper part thereof widening and equiaxed crystals hardly accumulate with chilled crystals of Ni inverse segregation acting as nuclei. Therefore, as the drum radius decreases the upper limit in the appropriate range of a pressing force beyond which salt-and-pepper unevenly glossy defects appear shifts toward a higher value.

On the other hand, when the pressing force is too small, there arises a problem of abnormal casting including the generation of center pores. In particular, as the drum radius decreases, the molten steel pool between drums shallows and thus the fluctuation of a molten steel surface increases. Therefore, the variation of solidified shell thickness increases over the direction of the sheet width. Furthermore, as the variations of reactive forces in the direction of drum width increases, for the above reasons, the casting operation shifts toward an unstable operation. Therefore, as the drum radius decreases the lower limit of a pressing force beyond which an abnormal casting occurs shifts toward a higher value. In contrast, as the drum radius increases, the variation of reactive force in the direction of drum width decreases and the stability of casting operation improves. Therefore, as the drum radius increases the lower limit of a pressing force beyond which an abnormal casting occurs shifts toward a lower value.

The present inventors intensively carried out studies by properly changing a drum radius R(m) and a pressing force P(t/m). According to the present invention the appropriate regions of a drum radius and a pressing force beyond which salt-and-pepper unevenly glossy defects occurs may be specified by the term $\sqrt{R}\times P$. In one embodiment of the present invention, a method of casting may include regulating a drum radius R(m) and a pressing force P(t/m) to satisfy the relation $0.5\leqq(\sqrt{R})\times P\leqq 2.0$. In another embodiment of the present invention, a method of casting may include regulating a drum radius R(m) and a pressing force P(t/m) to satisfy the relation $0.8\leqq(\sqrt{R})\times P\leqq 1.2$.

Figure 2:
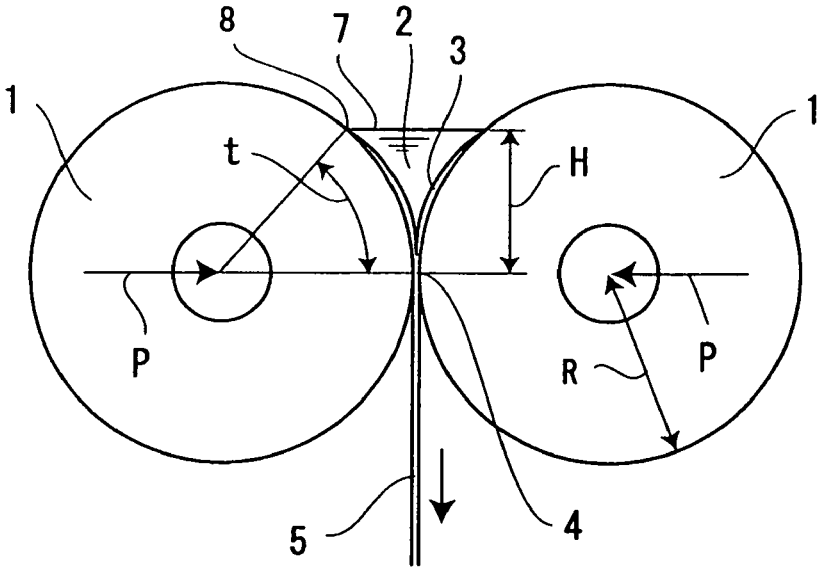
FIG. 2 is a diagram showing casting with a twin-drum type continuous caster.

In the case of a twin-drum type continuous caster for instance, as shown in FIG. 2, a molten steel pool 2 is formed on the space surrounded by a pair of drums 1 and side weirs to seal both end faces of the drums. There exists a range of heights H of the molten steel pool 2 in which salt-and-pepper unevenly glossy defects are minimized. As defined herein, the height H of a molten steel pool 2 is the distance from a kissing point 4 to a molten steel surface 7 as shown in FIG. 2. When the pool height H is less than 200 mm, though the time during which chilled crystals generated at a meniscus 8 grow is short, most of the grown chilled crystals accumulate directly to a kissing point 4 and therefore salt-and-pepper unevenly glossy defects are apt to be generated. In addition, when the pool height H is greater than 450 mm, though most of the chilled crystals generated at a meniscus 8 disperse and remelt in a molten steel pool, some surviving chilled crystals become large since they have enough time to grow, and the amount thereof accumulated at a kissing point 4 increases. Therefore, salt-and-pepper unevenly glossy defects are apt to be generated. Accordingly, a good result can be obtained by regulating a molten steel pool height H in the range from not less than about 200 mm to not more than about 450 mm.

The solidification time t is defined as the time between when the moving mold walls contact with molten steel at a meniscus 8 to the time when solidified shells 3 of both sides unite at a kissing point 4. The solidification time t may be determined by the shape of a molten steel pool 2 and the traveling speed of the mold walls. There exists in a solidification time t a range appropriate for producing a casting wherein salt-and-pepper unevenly glossy defects are minimized. When the solidification time t is shorter than 0.4 second, though the time during which chilled crystals generated at a meniscus grow is short, most of the grown chilled crystals accumulate directly to a kissing point 4 and therefore salt-and-pepper unevenly glossy defects are apt to be generated. In addition, when the solidification time t exceeds 1.0 second, though most of the chilled crystals generated at a meniscus 8 disperse and remelt in a molten steel pool, some surviving chilled crystals become large since they have a time enough to grow, the amount thereof accumulated to a kissing point 4 increases, and therefore salt-and-pepper unevenly glossy defects are apt to be generated. Accordingly, a good result can be obtained by regulating a solidification time t, the time from when the moving mold walls contact with molten steel to the time when the solidified shells of both sides unite, in the range from not shorter than about 0.4 second to not longer than about 1.0 second.

As explained above, as a pressing force P of the mold wall faces decreases, which suppresses the generation of salt-and-pepper unevenly glossy defects, abnormal casting including the generation of center pores is apt to occur. According to the present invention, it is possible to carry out casting stably with a small pressing force by applying in-line rolling during the process from molding to coiling, and thus bonding center pores with pressure. Though the situation varies depending on the composition of steel to be cast or the type of caster and drums, as long as rolling is applied to a casting with enough pressure and at a sufficiently high temperature to bond the center pores, it is possible to eliminate the effect of the center pores. In particular, as shown in FIG. 1, it is preferable to install an in-line rolling mill 6 at a place downstream of the drums 1, in which the temperature of a casting is not lower than about 1,000° C.

and apply rolling under the condition of reducing a thickness by not less than about 10% in terms of a sheet thickness ratio. Thus, as long as the center pores can bond, the pressure and rolling conditions are not restricted except by the temperature at which rolling is applied. Center pores tend to appear when a pressing force is weak and therefore the center pores may be by applying in-line rolling. Therefore, according to one embodiment of the present invention, a casting may be cast wherein the center pores are minimized by regulating a pressing force to more than 1.0 t/m. In particular, according to another embodiment of the present invention, it may be preferable to regulate a pressing force to more than 1.1 t/m to minimize the generation of center pores. In still another embodiment of the present invention, it may be preferable to regulate a pressing force to more than 1.2 t/m.

EXAMPLE

Figure 1:
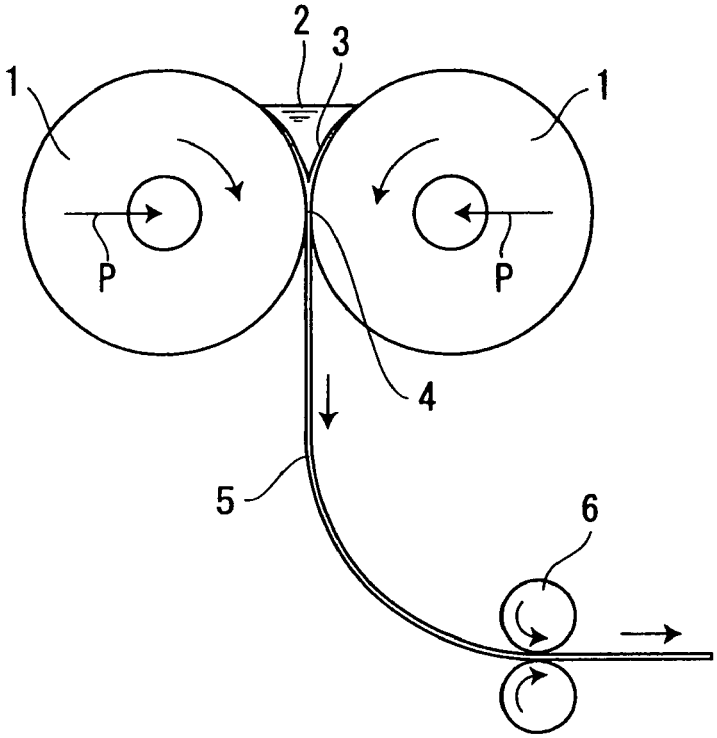
FIG. 1 is a diagram showing casting with a twin-drum type continuous caster.

A twin-drum type continuous caster as shown in FIG. 1 may be used according to the present invention. The width of each of the drums 1 was 1,000 mm, the thickness of each of the castings 3 mm, and the steel grade of each of the castings AISI 304 steel (austenitic stainless steel). The radius R of each of the drums 1 was 0.6 m in each example described below, except Example 2. The pool height H was 350 mm in each example described below, except Example 3. The solidification time t was 0.7 second in each example described below, except Example 4. When a drum radius R, a pool height H and a solidification time t are changed from the above values, the respective values are expressed in the relevant tables of the following examples.

In-line rolling was not applied in Examples 1 to 4 below, but the cases of applying and not applying in-line rolling were compared in Example 5 below. When in-line rolling was applied, the in-line rolling mill 6 shown in FIG. 1 was used for the rolling. The temperature of a casting at the entry of the rolling mill was 1,220° C. when in-line rolling was carried out. A reduction ratio of the in-line rolling was defined by the expression (the thickness of a casting—the thickness thereof after in-line rolling)/the thickness of a casting×100 in terms of percentage.

The castings that were cast were cold-rolled to the thickness of 1.0 mm and thereafter subjected to stretch forming to form the shape of a cylinder 50 mm in diameter as cold forming. In that case, two kinds of stretch forming was applied; light forming of 5 mm in stretch height and heavy forming of 30 mm in stretch height.

The degree of Ni inverse segregation was obtained by measuring an Ni amount over a region 100 μm in thickness direction and 1 cm in width direction at the middle portion of the thickness on the cross section in the direction of the width of a casting with an X-ray microanalyzer and calculating the ratio of Ni amount in the region to the Ni amount in a ladle (i.e., the amount of Ni in molten steel).

Salt-and-pepper unevenly glossy defects were determined by visually observing the surfaces of the specimens at the stage of cold-rolled steel sheets and after cold forming (both light forming and heavy forming). When salt-and-pepper unevenly glossy defects were conspicuous no further examination was necessary. When salt-and-pepper unevenly glossy defects were questionable, minute protrusions and depressions were determined as the unevenness of polish by scrubbing the surface with abrasive paper of about #1,000 in mesh. In any of the cases, spot-shaped or spindle-shaped patterns that were distributed in a zigzag were judged as salt-and-pepper unevenly glossy defects.

The area ratio of center pores was obtained by calculating the ratio (%) of the total area of center pores in the area of one square meter on the surface of a casting on the basis of radioparency photography.

Example 1

Figure 3:
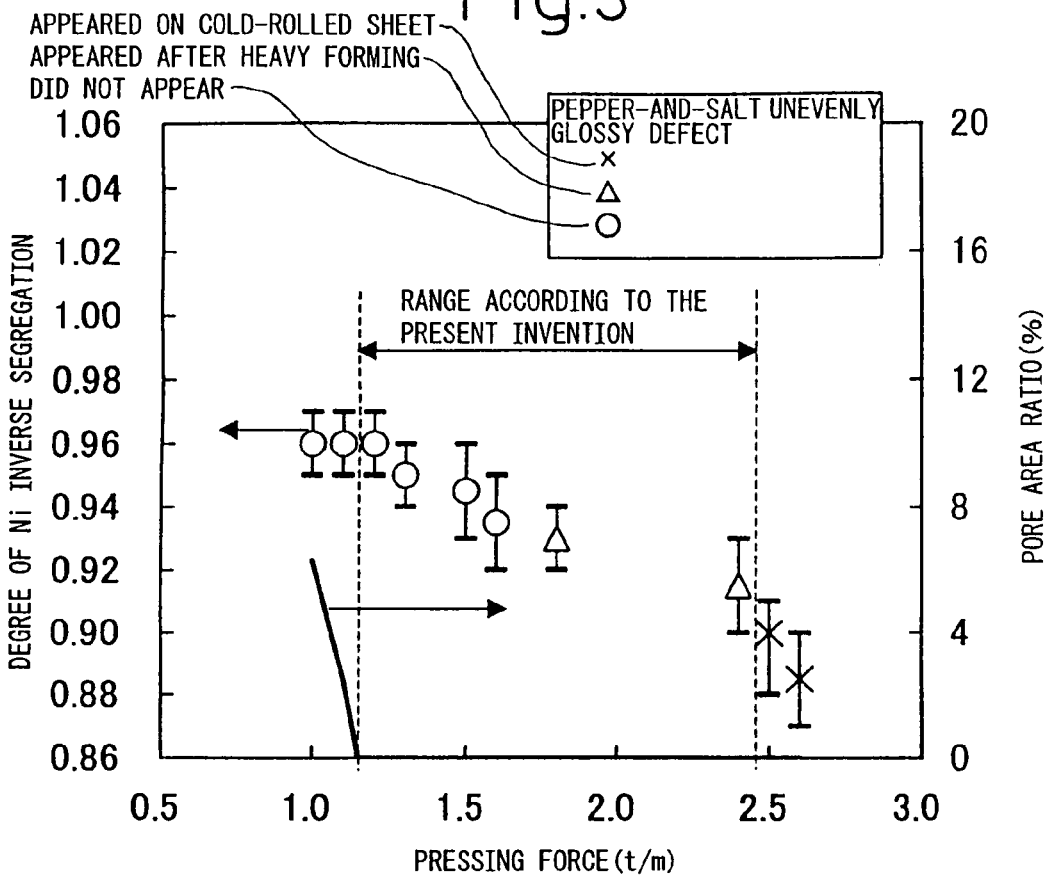
FIG. 3 is a graph showing the relation of the degrees of Ni inverse segregation, the existence of salt-and-pepper unevenly glossy defects, and the pore area ratios to the pressing forces of drums.

As shown in Table 1, the pressing forces P of the drums were varied in the range from 1.0 to 2.6 t/m, and the degrees of Ni inverse segregation, the existence of salt-and-pepper unevenly glossy defects and the center pore area ratios of the steel sheets were evaluated. The results are shown also in FIG. 3. In the case of No. 2 according to the present invention, the pressing force P was 1.1 t/m, no salt-and-pepper unevenly glossy defects appeared, which is good and, though center pores were generated at 2.5% in terms of an area ratio, the value was a level applicable to practical use. In the cases of Nos. 7 and 8 according to the present invention, the pressing forces P were 1.8 to 2.4 t/m and, though salt-and-pepper unevenly glossy defects appeared after subjected to heavy forming in cold forming, no salt-and-pepper unevenly glossy defects appeared at the stage of cold-rolled steel sheets and after light forming in cold forming. In the cases of Nos. 3 to 6 according to the present invention, the pressing forces P were in the range from 1.2 to 1.6 t/m, no salt-and-pepper unevenly glossy defects appeared, the center pore area ratios were 0%.

In case of No. 1 that was a comparative example, the pressing force P was 1.0 t/m and center pores were generated by 6.3% in terms of an area ratio. In the cases of Nos. 9 and 10 which were comparative examples, the pressing forces P were from 2.5 to 2.6 t/m and salt-and-pepper unevenly glossy defects appeared at the stage of cold-rolled steel sheets and also after cold forming.

Example 2

Figure 4:
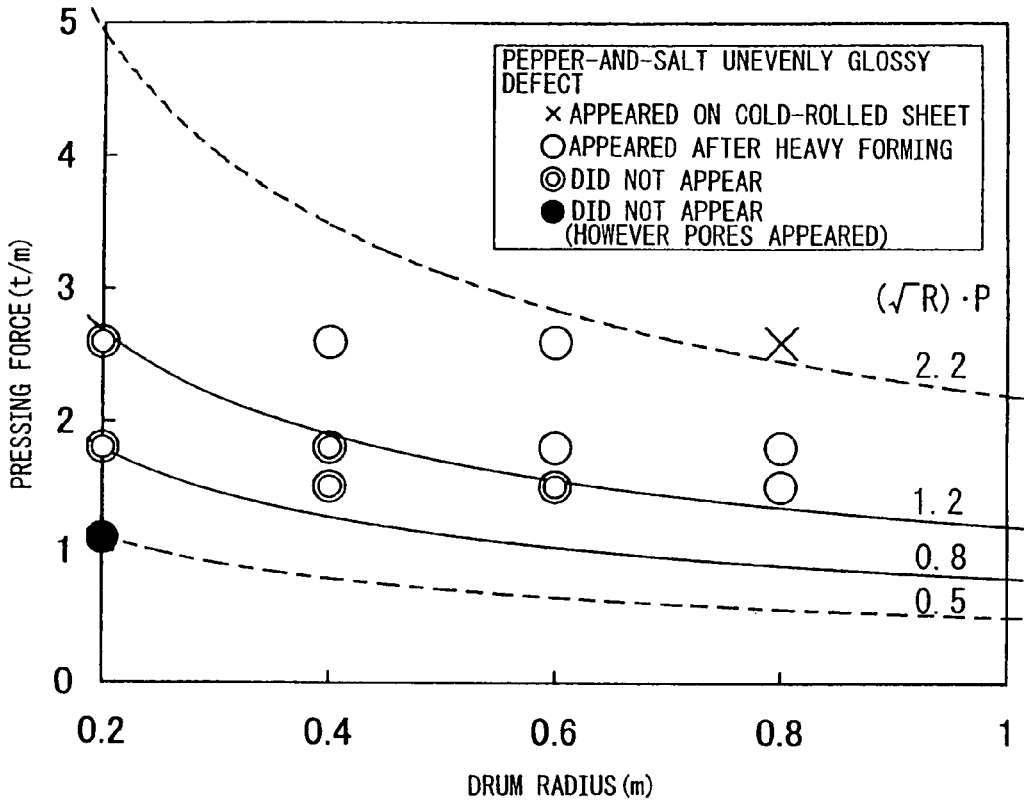
FIG. 4 is a graph showing the relation among the drum radiuses R, the pressing forces P, and the existence of salt-and-pepper unevenly glossy defects.

As shown in Table 2, the drum radiuses R were varied in the range from 0.2 to 0.8 m and the pressing forces P were varied at 4 levels, and then the existence of salt-and-pepper unevenly glossy defects and the relation between the center pore area ratios and the values $(\sqrt{R})\times P$ of the steel sheets were evaluated. The results are shown also in FIG. 4. The curves drawn in FIG. 4 are the ones that have respective identical $(\sqrt{R})\times P$ values; from above, $(\sqrt{R})\times P=2.2$ (the upper broken line), $(\sqrt{R})\times P=1.2$ (the upper solid line), $(\sqrt{R})\times P=0.8$ (the lower solid line) and $(\sqrt{R})\times P=0.5$ (the lower broken line).

In the cases of Nos. 12 to 21 according to the present invention, the values $(\sqrt{R})\times P$ were in the range from 0.8 to 2.0 and a good result was obtained in any of the cases. In the case of No. 11 according to the present invention, the value $(\sqrt{R})\times P$ was 0.5 and, though the center pore area ratio was 1.4%, the value was a level applicable to practical use. In the case of No. 22 that was a comparative example, the value $(\sqrt{R})\times P$ was 2.3 and the salt-and-pepper unevenly glossy defects were observed at the stage of the cold-rolled steel sheet and also after cold forming.

Example 3

As shown in Table 3, the molten steel heights H were varied in the range from 190 to 460 mm, the pressing forces P of the drums were fixed to 1.5 t/m, and then the existence of salt-and-pepper unevenly glossy defects of the steel sheets was evaluated. In the cases of Nos. 24 to 26, the molten steel heights H were in the appropriate range from 200 to 450 mm and salt-and-pepper unevenly glossy defects were not observed. In the cases of Nos. 23 and 27, as the molten steel heights H were outside the appropriate range, the salt-and-pepper unevenly glossy defects were observed.

Example 4

As shown in Table 4, the solidification times t were varied in the range from 0.3 to 1.1 seconds, the pressing forces P of the drums were fixed to 1.5 t/m, and then the existence of salt-and-pepper unevenly glossy defects of the steel sheets was evaluated. In the cases of Nos. 29 to 33, the solidification times t were in the appropriate range from 0.4 to 1.0 second and salt-and-pepper unevenly glossy defects were not observed. In the cases of Nos. 28 and 34, as the solidification times t were outside the appropriate range, the salt-and-pepper unevenly glossy defects were observed.

Example 5

As shown in Table 5, the pressing forces P of the drums were fixed to 1.1 t/m, in-line rolling was applied with the reduction ratios thereof varied or was not applied, and then the existence of salt-and-pepper unevenly glossy defects and the center pore area ratios of the steel sheets were evaluated. In the case of No. 35, as in-line rolling was not applied, the center pore area ratio was 2.5%. In the case of No. 36, in-line rolling was applied at the reduction ratio of 8% and the center pore area ratio was 8%. In the case of No. 37, the in-line rolling was applied at the reduction ratio of 10% and the center pore area ratio was 0%, resulting in a good result. Salt-and-pepper unevenly glossy defects did not appear in any of the above cases and good results could be obtained.

TABLE 1

| No. | Pressing force P; t/m | Degree of Ni inverse segregation | Salt-and-pepper unevenly glossy defect: Cold-rolled steel sheet | Salt-and-pepper unevenly glossy defect: Cold forming: Light forming | Salt-and-pepper unevenly glossy defect: Cold forming: Heavy forming | Center pore area ratio; % | Remarks |
|---|---|---|---|---|---|---|---|
| 1 | 1.0 | 0.95–0.97 | Nil | Nil | Nil | 6.3 | Comparative example |
| 2 | 1.1 | 0.95–0.97 | Nil | Nil | Nil | 2.5 | Invented example |
| 3 | 1.2 | 0.95–0.97 | Nil | Nil | Nil | 0 | Invented example |
| 4 | 1.3 | 0.94–0.96 | Nil | Nil | Nil | 0 | Invented example |
| 5 | 1.5 | 0.93–0.96 | Nil | Nil | Nil | 0 | Invented example |
| 6 | 1.6 | 0.92–0.95 | Nil | Nil | Nil | 0 | Invented example |
| 7 | 1.8 | 0.92–0.94 | Nil | Nil | Present | 0 | Invented example |
| 8 | 2.4 | 0.90–0.93 | Nil | Nil | Present | 0 | Invented example |
| 9 | 2.5 | 0.88–0.91 | Present | Present | Present | 0 | Comparative example |
| 10 | 2.6 | 0.87–0.90 | Present | Present | Present | 0 | Comparative example |

TABLE 2

| No. | Pressing force P; t/m | Drum radius R; m | $\sqrt{R \cdot P}$ | Salt-and-pepper unevenly glossy defect: Cold-rolled steel sheet | Salt-and-pepper unevenly glossy defect: Cold forming: Light forming | Salt-and-pepper unevenly glossy defect: Cold forming: Heavy forming | Center pore area ratio; % | Remarks |
|---|---|---|---|---|---|---|---|---|
| 11 | 1.1 | 0.2 | 0.5 | Nil | Nil | Nil | 1.4 | Invented example |
| 12 | 1.8 | 0.2 | 0.8 | Nil | Nil | Nil | 0 | Invented example |
| 13 | 2.6 | 0.2 | 1.2 | Nil | Nil | Present | 0 | Invented example |
| 14 | 1.5 | 0.4 | 0.9 | Nil | Nil | Nil | 0 | Invented example |
| 15 | 1.8 | 0.4 | 1.1 | Nil | Nil | Nil | 0 | Invented example |
| 16 | 2.6 | 0.4 | 1.6 | Nil | Nil | Present | 0 | Invented example |
| 17 | 1.5 | 0.6 | 1.2 | Nil | Nil | Nil | 0 | Invented example |

TABLE 2-continued

| No. | Pressing force P; t/m | Drum radius R; m | $\sqrt{R \cdot P}$ | Salt-and-pepper unevenly glossy defect: Cold-rolled steel sheet | Cold forming: Light forming | Cold forming: Heavy forming | Center pore area ratio; % | Remarks |
|---|---|---|---|---|---|---|---|---|
| 18 | 1.8 | 0.6 | 1.4 | Nil | Nil | Present | 0 | Invented example |
| 19 | 2.6 | 0.6 | 2.0 | Nil | Nil | Present | 0 | Invented example |
| 20 | 1.5 | 0.8 | 1.3 | Nil | Nil | Present | 0 | Invented example |
| 21 | 1.8 | 0.8 | 1.6 | Nil | Nil | Present | 0 | Invented example |
| 22 | 2.6 | 0.8 | 2.3 | Present | Present | Present | 0 | Comparative example |

TABLE 3

| No. | Pressing force P; t/m | Drum radius R; m | Molten steel height H; mm | Salt-and-pepper unevenly glossy defect: Cold-rolled steel sheet | Cold forming: Light forming | Cold forming: Heavy forming |
|---|---|---|---|---|---|---|
| 23 | 1.5 | 0.6 | 190 | Nil | Nil | Present |
| 24 | 1.5 | 0.6 | 210 | Nil | Nil | Nil |
| 25 | 1.5 | 0.6 | 350 | Nil | Nil | Nil |
| 26 | 1.5 | 0.6 | 440 | Nil | Nil | Nil |
| 27 | 1.5 | 0.6 | 460 | Present | Present | Present |

TABLE 4

| No. | Pressing force P; t/m | Drum radius R; m | Solidification time t; second | Salt-and-pepper unevenly glossy defect: Cold-rolled steel sheet | Cold forming: Light forming | Cold forming: Heavy forming |
|---|---|---|---|---|---|---|
| 28 | 1.5 | 0.6 | 0.3 | Nil | Nil | Present |
| 29 | 1.5 | 0.6 | 0.4 | Nil | Nil | Nil |
| 30 | 1.5 | 0.6 | 0.5 | Nil | Nil | Nil |
| 31 | 1.5 | 0.6 | 0.7 | Nil | Nil | Nil |
| 32 | 1.5 | 0.6 | 0.9 | Nil | Nil | Nil |
| 33 | 1.5 | 0.6 | 1.0 | Nil | Nil | Nil |
| 34 | 1.5 | 0.6 | 1.1 | Present | Present | Present |

TABLE 5

| No. | Pressing force P; t/m | Drum radius R; m | In-line reduction ratio; % | Salt-and-pepper unevenly glossy defect: Cold-rolled steel sheet | Cold forming: Light forming | Cold forming: Heavy forming | Center pore area ratio; % |
|---|---|---|---|---|---|---|---|
| 35 | 1.1 | 0.6 | 0 | Nil | Nil | Nil | 2.5 |
| 36 | 1.1 | 0.6 | 8 | Nil | Nil | Nil | 1.1 |
| 37 | 1.1 | 0.6 | 10 | Nil | Nil | Nil | 0 |

The present invention, in a method of casting an austenitic stainless steel thin strip casting with a continuous caster wherein mold walls move synchronously with the casting, makes it possible to prevent salt-and-pepper unevenly glossy defects distributed zigzag in the form of spots from appearing on a steel sheet after cold rolling and cold forming by regulating a pressing force P of mold wall faces in the appropriate range from more than about 1.0 to less than about 2.5 t/m.

The invention claimed is:

1. A method for producing an austenitic stainless steel thin strip casting through a continuous caster wherein mold walls move synchronously with the casting, comprising applying a pressing force P of the at least one mold wall face against the casting wherein the pressing force is more than about 1.1 and less than about 1.6 t/m.

2. The method of claim 1 wherein a height of a molten steel pool formed between at least two mold walls is more than about 200 mm and less than about 450 mm.

3. The method of claim 1 wherein a solidification time, defined by a span of time between a time when at least one moving mold wall contacts molten steel to a time when at least two solidified shells unite, is more than about 0.4 second and less than about 1.0 second.

4. The method of claim 1 wherein in-line rolling is applied during the process from molding to coiling.

5. The method of claim 1 wherein a degree of Ni inverse segregation, defined by the ratio of an amount of Ni at Ni inverse segregation portions to an average amount of Ni in an entire steel is in the range from about 0.90 to about 0.97.

6. A method for producing an austenitic stainless steel thin strip casting through a continuous caster wherein mold walls move synchronously with the casting wherein the continuous caster is a twin-drum type continuous caster, and wherein the drum radius R (m) and the pressing force P (t/m) of at least one mold wall face satisfies the relation $0.8 \leqq (\sqrt{R}) \times P \leqq 2.0$.

7. The method of claim 6 wherein a height of a molten steel pool formed between at least two mold walls is more than about 200 mm and less than about 450 mm.

8. The method of claim 6 wherein a solidification time, defined by a span of time between a time when at least one moving mold wall contacts molten steel to a time when at least two solidified shells unite, is more than about 0.4 second and less than about 1.0 second.

9. The method of claim 6 wherein in-line rolling is applied during the process from molding to coiling.

10. The method of claim 6 wherein a degree of Ni inverse segregation, defined by the ratio of an amount of Ni at Ni inverse segregation portions to an average amount of Ni in an entire steel is in the range from about 0.90 to about 0.97.

11. A method for producing an austenitic stainless steel thin strip casting through a continuous caster wherein mold walls move synchronously with the casting, comprising applying a pressing force P of the at least one mold wall face against the casting is more than about 1.1 and less than about 1.6 t/m, and the drum radius R (m) and the pressing force P (t/m) of at least one mold wall face satisfies the relation $0.8 \leqq (\sqrt{R}) \times P \leqq 2.0$.

* * * * *